US006640975B2

(12) United States Patent
Bennett et al.

(10) Patent No.: US 6,640,975 B2
(45) Date of Patent: Nov. 4, 2003

(54) STACKABLE SELF-ALIGNING CONTAINER

(75) Inventors: James A. Bennett, Yorba Linda, CA (US); Bradley Heath, Huntington Beach, CA (US); Jody Hamabata, Walnut, CA (US)

(73) Assignee: Conagra Grocery Products Company, Irvine, CA (US)

( * ) Notice: Subject to any disclaimer, the term of this patent is extended or adjusted under 35 U.S.C. 154(b) by 0 days.

(21) Appl. No.: 10/126,025

(22) Filed: Apr. 19, 2002

(65) Prior Publication Data

US 2003/0038051 A1 Feb. 27, 2003

Related U.S. Application Data

(60) Provisional application No. 60/313,935, filed on Aug. 21, 2001.

(51) Int. Cl.[7] ..... B65D 21/032

(52) U.S. Cl. ..... 206/509; 229/191; 229/915; 229/918

(58) Field of Search ..... 229/191, 915, 229/918, 919; 206/509, 511, 512

(56) References Cited

U.S. PATENT DOCUMENTS

| | | | | | |
|---|---|---|---|---|---|
| 1,653,116 | A | * | 12/1927 | Parks | 229/191 |
| 2,350,932 | A | * | 6/1944 | Schaefer | 206/511 |
| 4,807,756 | A | * | 2/1989 | Young et al. | 206/509 |
| 4,860,948 | A | * | 8/1989 | Hofstede | 229/918 |
| 5,487,505 | A | * | 1/1996 | Nilsson | 229/918 |
| 5,549,242 | A | * | 8/1996 | Gimeno | 229/191 |
| 5,992,735 | A | * | 11/1999 | Oosterbaan | 229/918 |
| 6,186,393 | B1 | * | 2/2001 | Tsamourgelis | 229/191 |
| 6,378,764 | B1 | * | 4/2002 | Teixidor Casanovas | 206/512 |

FOREIGN PATENT DOCUMENTS

| | | | | | |
|---|---|---|---|---|---|
| DE | 4003104 | A1 | * | 8/1991 | 206/509 |
| EP | 453015 | A2 | * | 10/1991 | 229/915 |
| EP | 576325 | A1 | * | 12/1993 | 229/915 |

* cited by examiner

*Primary Examiner*—Gary E. Elkins
(74) *Attorney, Agent, or Firm*—Bingham McCutchen LLP

(57) ABSTRACT

A box or container, formed from a single blank, with a group of protruding tabs and corresponding bottom apertures which act together to urge, and maintain, the alignment of an upper box on top of a lower box during the stacking of similar boxes.

36 Claims, 8 Drawing Sheets

STACKABLE SELF-ALIGNING CONTAINER

CROSS-REFERENCE TO RELATED APPLICATION(S)

This application claims priority of U.S. Provisional Patent Application No. 60/313,935, filed Aug. 21, 2001, the entire disclosure of which is incorporated herein by reference.

BACKGROUND OF THE INVENTION

The present invention relates to the field of containers. More particularly, the present invention relates to stackable cardboard containers with stacking guides that are self-aligning.

DESCRIPTION OF THE PRIOR ART

Three general types of stackable cardboard boxes with interlocking and stack stabilizing features, primarily used for the packaging and transportation of perishables such as fruits and vegetables, are known in the art. The first type has tabs, extended from a side or end wall, that fit into a corresponding slot or pocket. Examples may be found in U.S. Pat. No. 5,452,848 issued to Mur Gimeno and U.S. Pat. No. 3,940,053 issued to Putman and Wytko. A second type of box maintains stability in a stack by resting each corner of an upper box into the extended corner catches of a lower box. Examples are found in U.S. Pat. No. 4,053,098 issued to Baptist and U.S. Pat. No. 5,549,242 issued to Gimeno.

A third type of stack stabilizing solution is described in U.S. Pat. No. 5,487,505 issued to Nilsson, in which a foldable carton has a partially lowered sidewall to increase airflow around packed produce. The carton is constructed by inserting a group of flaps into corresponding slots, which both hold the box together and provide a diagonal corner support. Tabs extend from each corner support of a lower carton and fit into corresponding slots in the bottom of an upper carton. To mate boxes with the Nilsson tab and slot system, the operator must first accurately align and insert a tab into the appropriate slot.

While these known types of stack stabilizing systems can maintain alignment of a stack of boxes, they do not completely address certain stacking problems. They generally require a relatively high degree of precision to accurately align the tabs and slots. A slight misalignment between a tab and slot often results in the tab being folded over or crushed and therefore rendered ineffective. The tab solutions may also fail to compensate for the destabilizing effect of a worn tab. A worn tab, which is precisely aligned in a slot may nonetheless be able to "drift" longitudinally within the slot, thereby allowing the stack to be moved out of plumb.

Accordingly, a container in which the tabs of a lower box both capture the misaligned apertures of a similar upper box and guide the upper box into alignment would be desirable. Additionally, a stack-stabilizing system which reduces the "drift" of a properly inserted worn tab, thereby causing a stack of boxes, even one with worn or damaged tabs, to remain in plumb, would also be desirable.

SUMMARY OF THE INVENTION

It is an object of this invention to provide an improved box or container which, by virtue of its interlocking tabs and apertures, can compensate for stacking misalignments and urge boxes into proper alignment during stacking. Once stacked, the movement of an interlocking tab within an aperture is further inhibited by a tab guide or recess surrounding the interlocking tab. Such a box can be constructed by scoring and folding a single sheet of material known as a "blank". To strengthen the corners of the box and resist collapsing during stacking, a corner panel extends from sidewall to end wall diagonally across each of the corners. Each corner panel can also support an upwardly projecting interlocking tab. To provide even more vertical or stacking support, particularly in the corner areas, multiple blanks can be used as in a bliss-type container.

Each tab is shaped to form a narrow head generally tapering outwardly toward a wide base. Apertures, of a dimension equal to the wide base of each tab, and therefore "oversized" relative to the narrow head, are formed in the bottom of the box. The aperture can advantageously be round. The self-alignment feature is derived from the interaction of the generally tapered tabs and relatively "oversized" apertures which serve the following dual functions: (1) tab placement, the "oversized" apertures can accept a misaligned tab head, thereby facilitating tab placement within the apertures without as high a degree of stacking precision; and (2) self-alignment, the tab widens from head to base as it fills the aperture thereby tending to cause alignment of the tabs within the apertures.

When stacking boxes which have this self-alignment system, because the tabs are positioned above the bottom panel and remote from the outer walls of the box, the apertures formed in the bottom panel are able to catch the tab's narrow head, although it may be misaligned in any direction with respect to the center of the aperture. Then, once a tab's narrow head is within the vicinity of an aperture and the upper box is lowered, the apertures of the upper box are filled with the girth of the tab's wide base thereby urging the upper box into alignment with the lower box.

In previously known boxes with slot and tab arrangements, a slight misalignment of the tab and slot will often result in the tab being bent or crushed. In the case of boxes with reinforced tabs, misalignment results in the boxes stacking unevenly with protruding tabs, preventing a positive interlock of box bottoms and tops.

The integrity of a stack of boxes constructed according to the invention may be further enhanced by causing the tabs of a lower box to be inserted into corresponding tab recesses of an upper box. Another advantage over other tab recess is that alignment of the stacked boxes is maintained by the circumference of the tab against the outline of the recess. This recess is more effective at maintaining a positive lock on a damaged tab than prior art slots which will allow a tab with edge damage near its base to "drift". Tab "drift" is the side to side movement of a tab within a slot resulting when a tab's worn edge, near its base, allows the fully inserted tab to move. A drifting tab will allow a stack of boxes to move out of plumb and thereby destabilizes the entire stack.

Another noteworthy feature of this invention is that crush strength and load-bearing capacity of the box has been increased by forming a region of double thick wall near each end of each sidewall thereby minimizing the length of the region of single thickness sidewall.

DESCRIPTION OF THE PREFERRED EMBODIMENTS OF THE INVENTION

Figure 1:
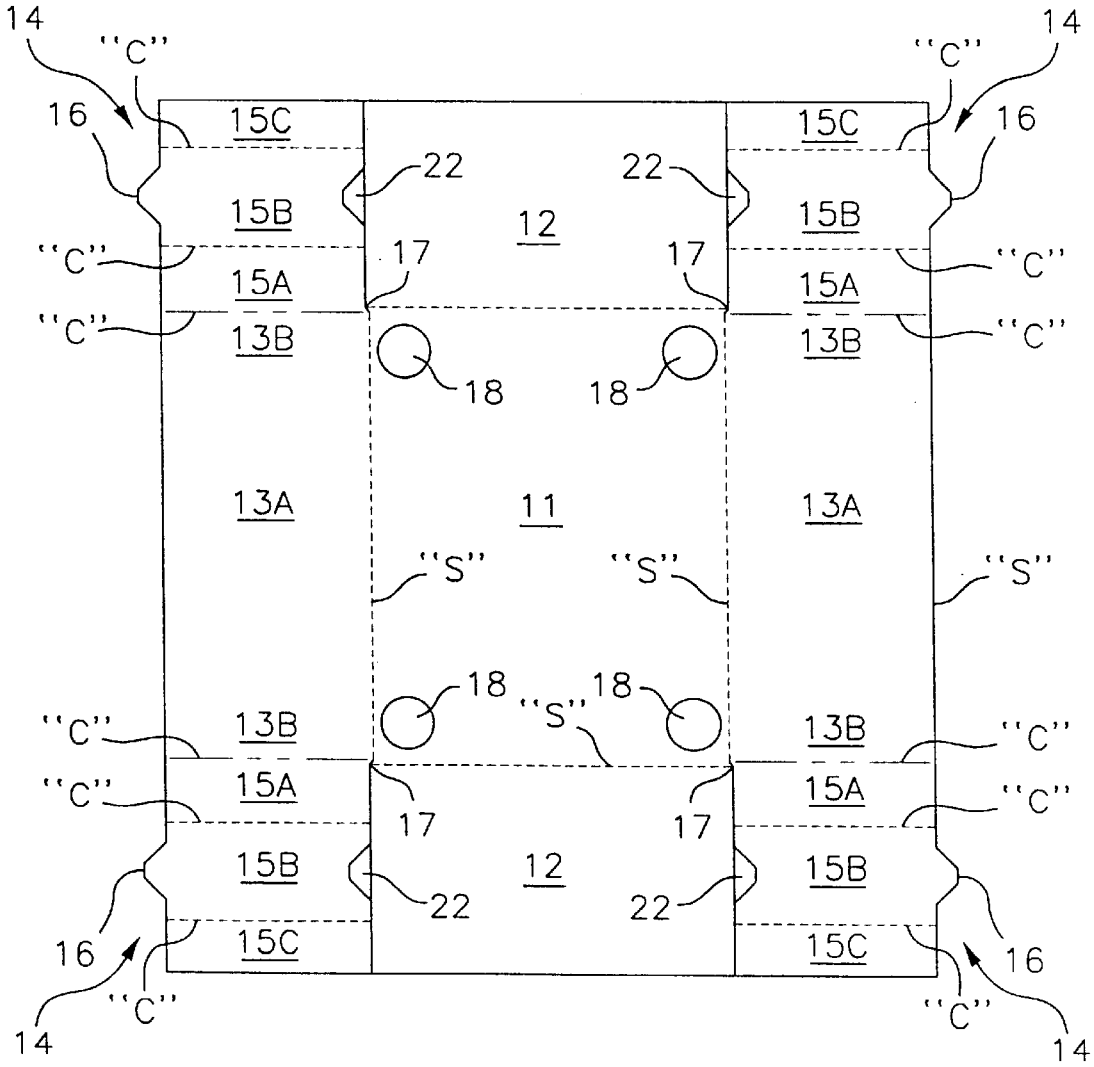
FIG. 1 is a plan view of the foldable sheet from which a container in accordance with the present invention can be constructed.

In one preferred embodiment of the invention, an open container (FIG. 2) generally designated 10, is formed by folding a single flat die-cut and scored sheet of corrugated cardboard (FIG. 1). Extending from a bottom panel 11 are two opposing end walls 12 and two opposing sidewalls 13A. Extending from the end of each sidewall 13B is a corner flap 14, which has score marks "S" dividing it into three contiguous parallel corner panels. The first corner panel 15A extends from the end of the sidewall 13B to the middle corner panel 15B, which extends to the end corner panel 15C. An interlocking tab 16 extends from each middle corner panel 15B. Each tab 16 has straight sides that taper inwardly toward the top so that it has, in general, the shape of a triangle that has been truncated nears its apex so as to have a short flat horizontal top surface.

Figure 2A:
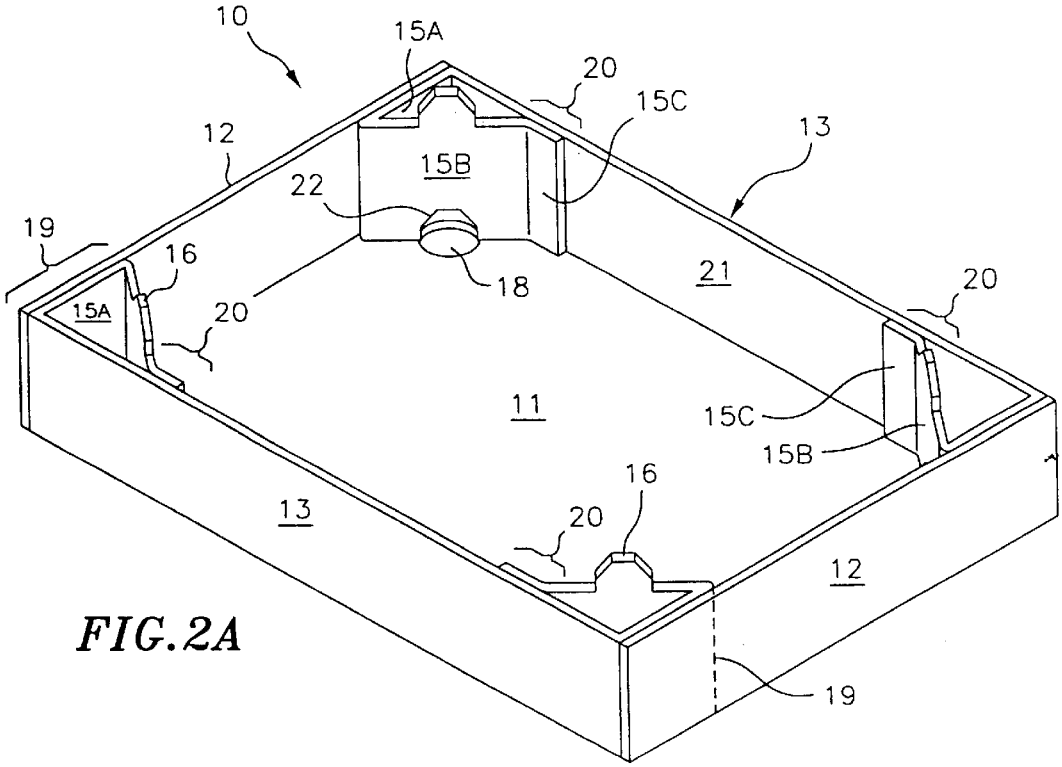
FIG. 2A is a perspective view of a container made from the blank of FIG. 1.

The container 10 is constructed (FIG. 2) around each of its corners 17. The first corner panel 15A is affixed to an end wall 12. The middle corner panel 15B extends diagonally from the first corner panel 15A, across the corner 17, over an aperture 18 to the end corner panel 15C. The aperture has a diameter sufficient to mate with the widest portion of the interlocking tab 16 (FIG. 2C). The end corner panel 15C is then affixed to a sidewall 13. The first and end corner panels 15A and 15C also function as attachment flaps and can be affixed to corresponding side or end walls with cold or hot adhesives. Staples may be used in place of the adhesive.

The side walls 13A and end walls 12, according to the terminology used here, refer to sets of opposing walls and the corner flaps 14 that are shown extending from the side walls 13. It is not intended, however, that the terms "side" and "end" denote relative length.

Figure 2B:
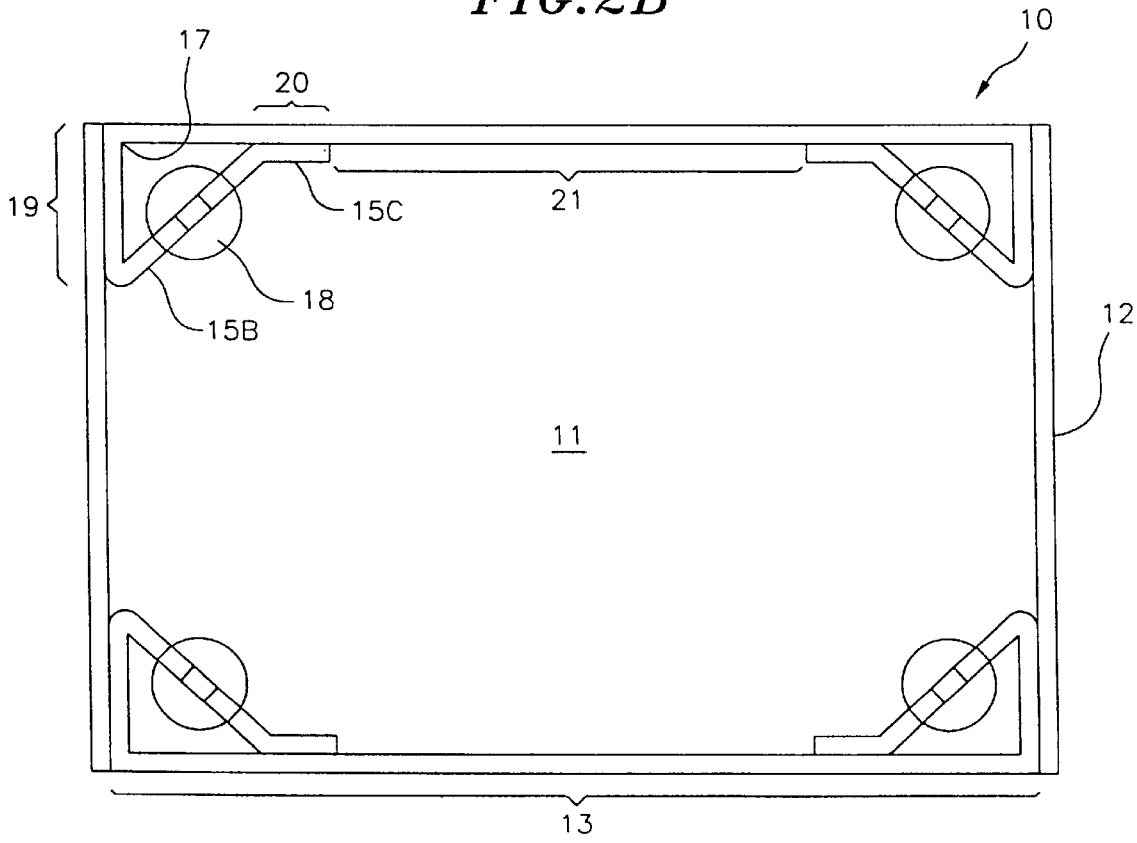
FIG. 2B is a top view of the container of FIG. 2A.
Figure 2C:
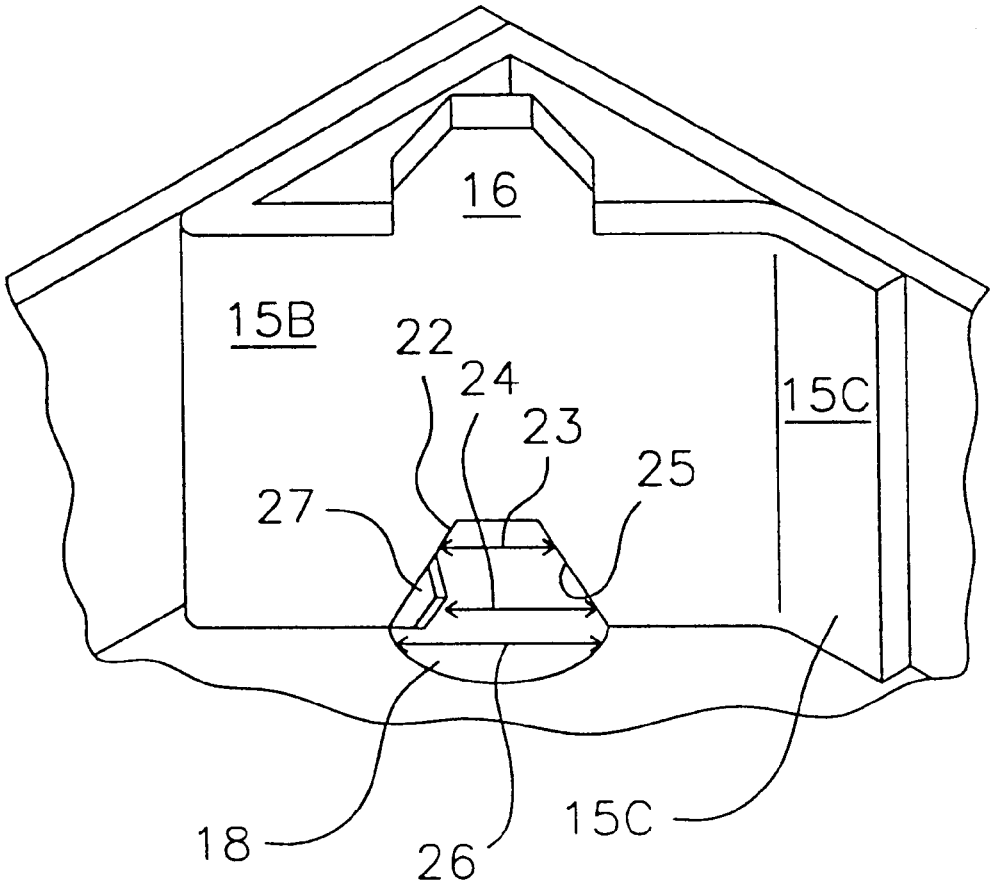
FIG. 2C is a close-up view of the interlocking tab, aperture and the tab-receiving sleeve of the container of FIG. 2A.

FIG. 2B shows a top view of an assembled container formed from the flat die-cut sheet (FIG. 1). Reinforced double thick regions 19 and 20 are formed where the first corner panels 15A are affixed against the end walls 12 and where the end corner panels 15C are affixed against the side walls 13A. By directing the end corner panels 15C toward the center of the side walls 13A, the largest single thick region 21 of side wall 13A is minimized, and the structural integrity of the container and the load bearing capacity is increased.

Figure 3:
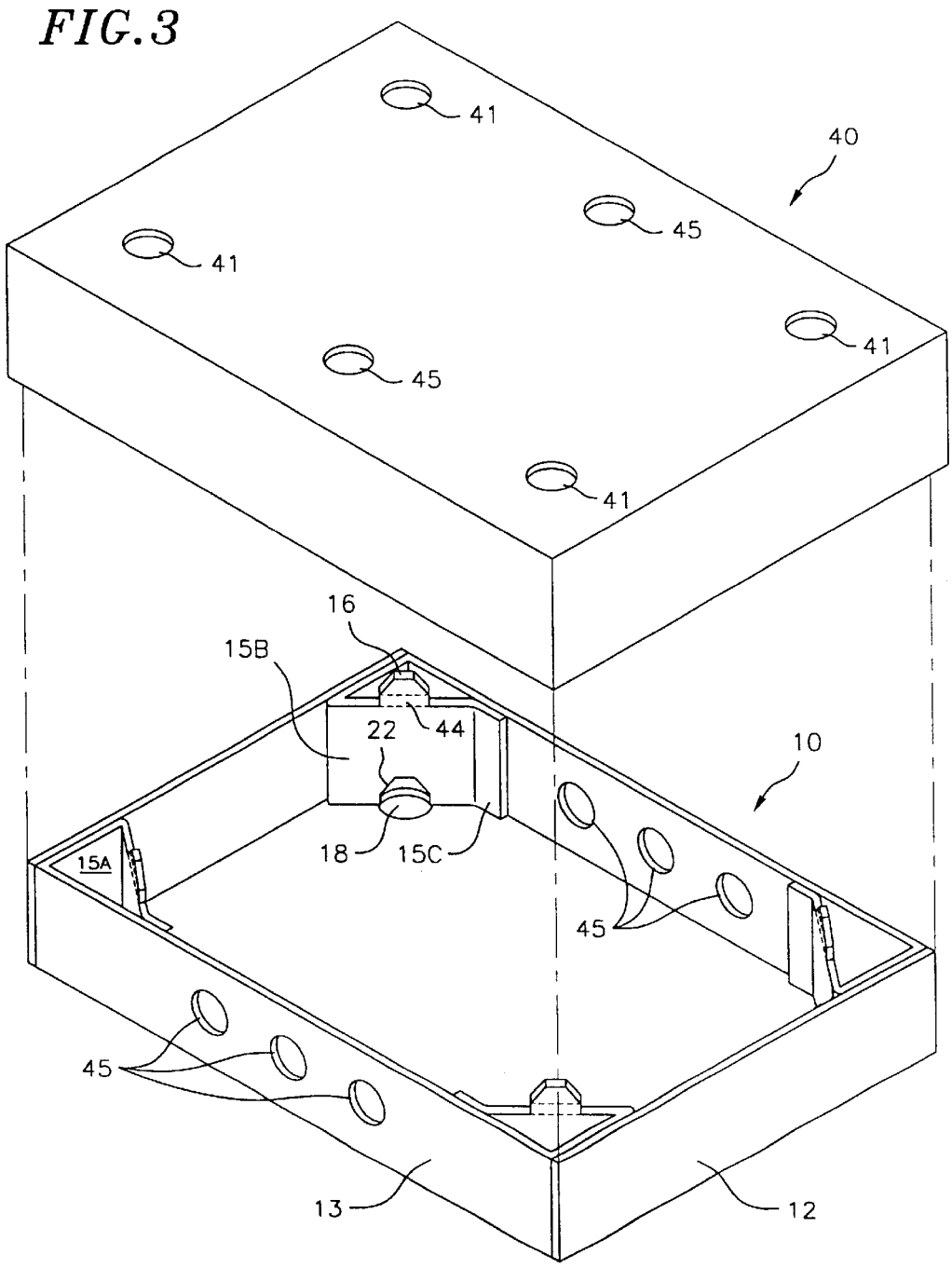
FIG. 3 is a perspective view of an alternative container reconstruction with a removable top.
Figure 3A:
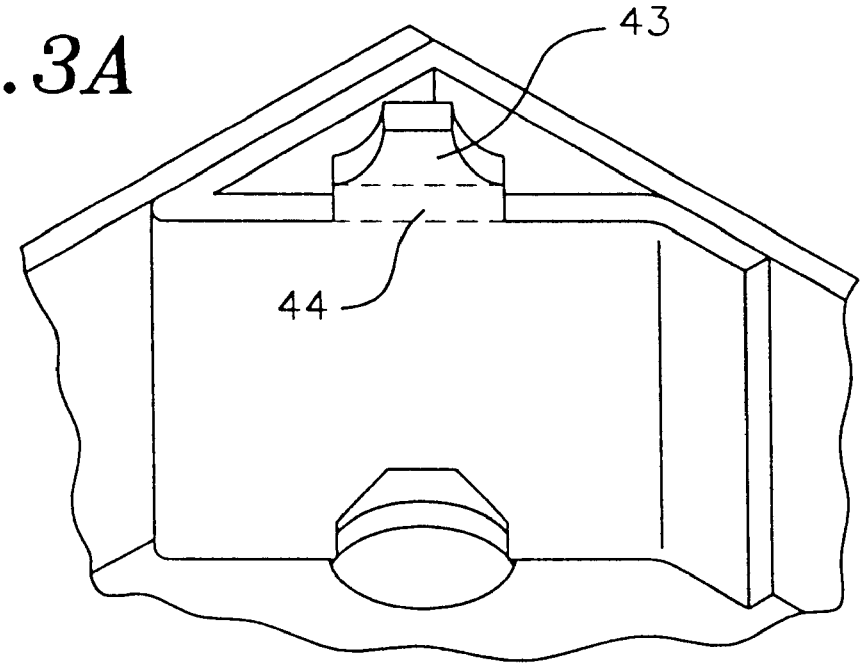
FIGS. 3*a* AND 3*b* are fragmentary perspective views of containers similar to that of FIG. 2*a*, but having differently shaped interlocking tabs.

A removable cover 40 may be added to the container 10 (FIG. 3). Die-cut through the cover 40 are tab channels 41, which correspond to the positions of the tabs 16. Any of a variety of tab configurations can thus be substituted for the straight tapered tab 16 to capture misaligned upper box apertures and bring about alignment as described herein.

Figure 3B:
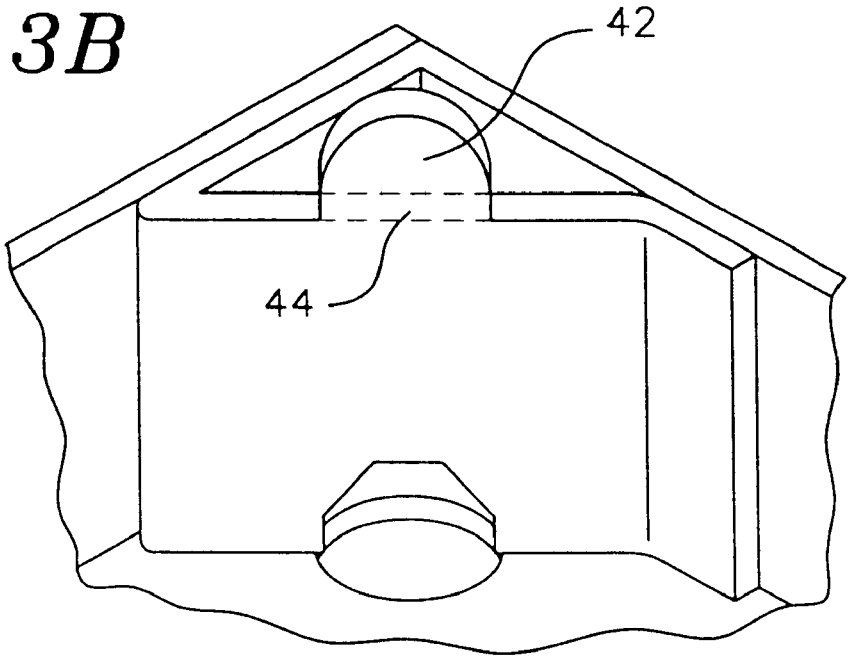

Whether or not a cover 40 is used, the interlocking tabs may have a variety of alternative shapes, exemplified by the configuration 44 having the inwardly inclined concaved sides of the tab 43 of FIG. 3 or the rounded semi-circular configuration 44 of the tab 42 of FIG. 3B. Each tab 16, 42 or 43 is preferably elongated having a base extension 44 with short straight vertical sides, which is substantially the height and the thickness of the cover 40, thereby assuring a positive lock of each tab within the corresponding aperture and tab recess 22. The tab channels 41 allow the tabs to protrude and continue to function in concert with the apertures 18. Vent holes 45 may be die-cut within the container 10 or cover 40 for ventilation, if required by the intended use of the container.

An enlarged view of an interlocking tab 16 of a lower box fitted with an aperture 18 of an upper box is shown in FIG. 2C. The interlocking tab 16, once through the aperture 18, fits into a corresponding tab recess 22 formed in each middle corner panel 15B. The circular apertures 18 illustrated are advantageous but other shapes which will accommodate the tabs 16 can be used. A plethora of geometric shapes such as squares, hexagons, polygons, octagons, trapezoids, or ovoids may be chosen.

It is important to the self-alignment mechanism that the interlocking tabs have a narrow head 23 and a wide base 24 connected by inwardly extending tab side walls 25. During stacking of upper and lower boxes, constructed according to the preferred embodiment, precise manual or machine alignment of the tabs 16 and apertures 18 is not required. A misaligned upper box, which captures at least the narrow heads 23 of the tabs of a lower box, will be urged into alignment as it descends along the tab's side wall 24 until each wide base 24 fits across the diameter 26 of each aperture 18.

The tab 16 and corresponding tab recess 22 shape, which are depicted as a straight taper are not intended to represent the exclusive tab and recess combination. Tabs and recesses with curved tapers or which generally widen from top to bottom may be substituted and will capture misaligned upper box apertures and urge the alignment as described herein.

Another advantage of the present invention over the prior art is that a tab 16, which has suffered a loss or distortion of some portion of the edge structure, defined herein as "wear and tear", can still be held firmly in place. Specifically, in the case of other tab and slot alignment systems, once the side of the tab suffers wear and tear, a stack of boxes may become less stable because the tab of a lower box may be able to drift from side-to-side within the slot of an upper box, thereby displacing the upper box. In the present invention, because the tabs 16 of a lower box fit into tab recess 22 of an upper box, wear and tear damage to the side 27 of a tab need not lead to drift. Because the tab recess 22 matches the entire body of the tab 16, degradation to a tab's sidewall 27 which would cause drift in the prior art arrangement will not have the same effect in the present invention.

Figure 4:
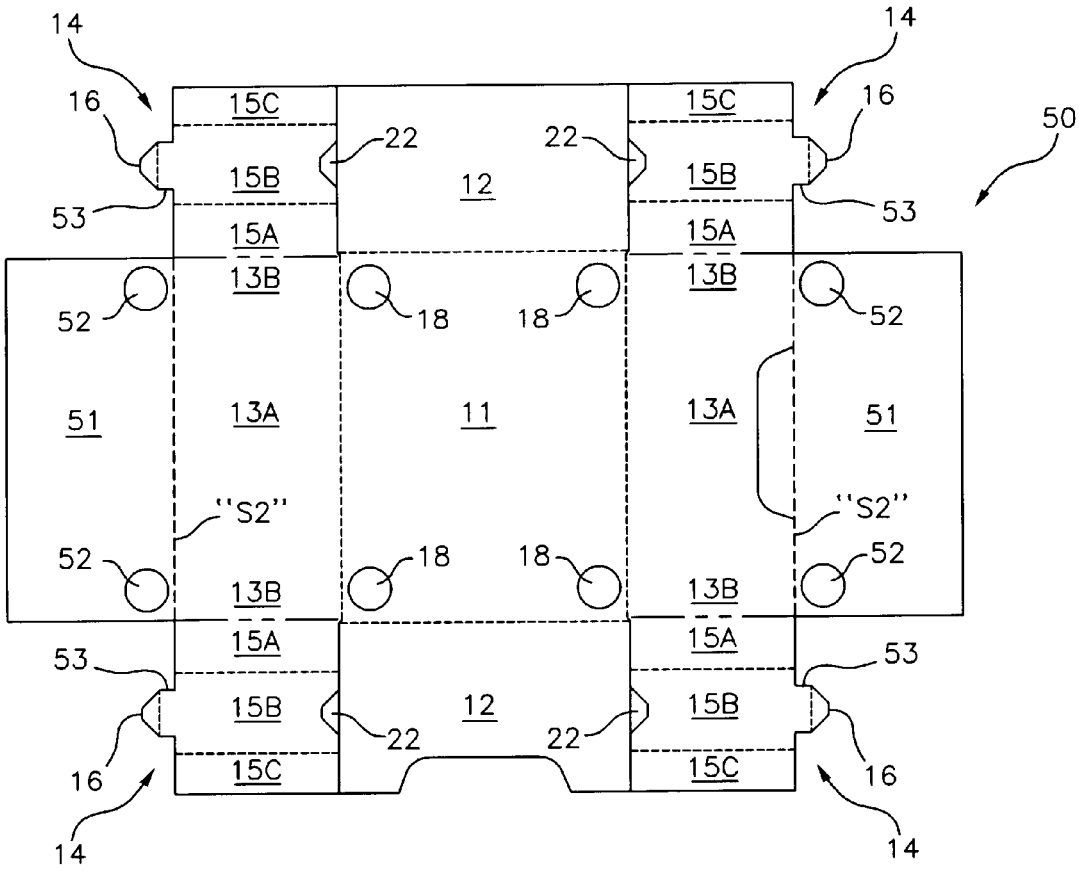
FIG. 4 is a plan view of the foldable sheet, which forms a stackable self-aligning container with a cover.

A preferred covered embodiment of this invention (FIG. 4) can be folded from a blank similar to the preferred embodiment 10. A half cover 51 extends from the sidewalls 13A along a score line "S2". Tab channels 52 are formed in each half cover to allow passage of the tabs 16. A base extension 53, is substantially the height and the thickness of the half cover 51, thereby assuring a positive lock of each tab within the corresponding aperture and tab recess 22. The tab channels 52 allow the tabs to protrude and continue to function in concert with the apertures 18 of an upper box (not shown).

Lowered regions 54 of the sidewall 13A or end wall 12 may be die-cut in the blank to allow for ventilation, especially important for packed produce and other perishable goods.

Figure 5:
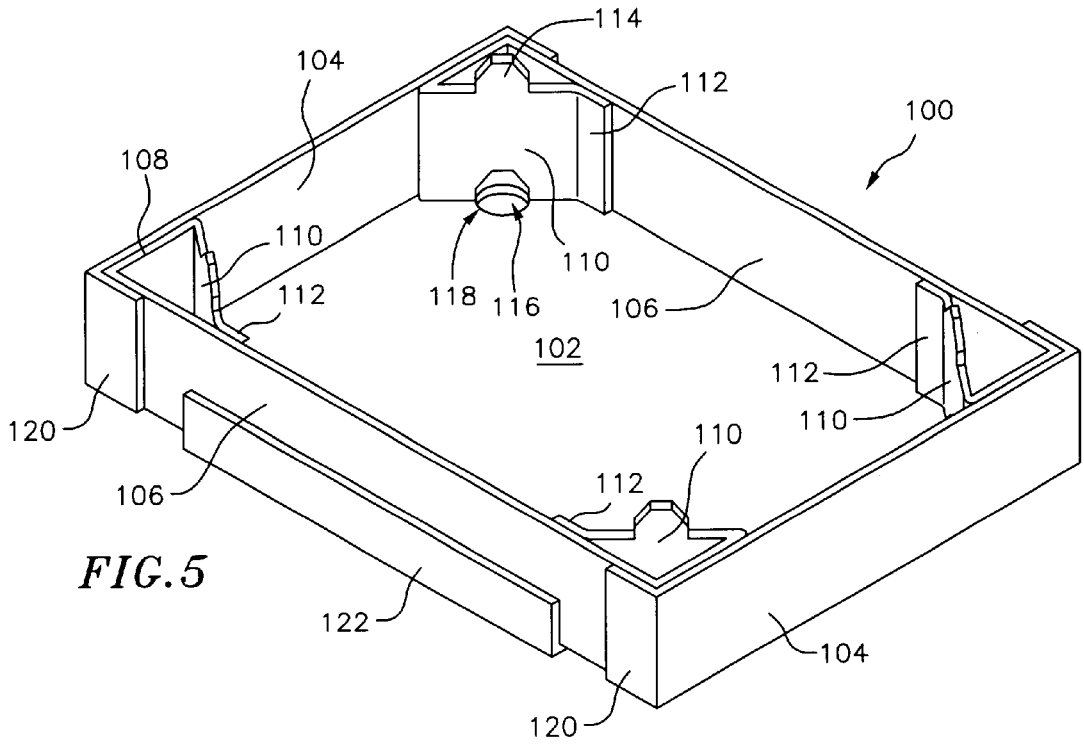
FIGS. 5 and 6 are perspective views of other containers embodying the invention that are each formed from multiple blanks.

FIG. 5 shows another embodiment of the invention in the form of a container 100 that, instead of being made from a single blank, as in the case of the container 10 of FIG. 2A, is made by combining a primary blank and two secondary blanks. The primary blank forms a bottom panel 102 and two side panels 104. Each secondary blank includes one end wall 106. At each corner of the container, and thus at each end of a secondary blank, an extension flap 108, which is part of the secondary blank, extends at a right angle from the end wall 106. A corner flap 110 extends at a 45° angle to the extension flap 108 so that it is folded back toward the end wall 106, thus being positioned diagonally across each corner of the container 100. It is then secured to the end wall 106 by a smaller rectangular attachment flap 112. Each corner panel 110 includes an interlocking tab 114 that extends upwardly and a corresponding tab recess 116 along its lower edge in the manner of the tab 16 of the container 100 described above. The corner flap 110 is aligned with a diameter of a circular aperture 118 formed in the bottom panel 102. When the containers are stacked, the four tabs 114 of the container are received by the apertures 118 of the container above, in the same manner described above with respect to other embodiments.

The end walls 106 are secured adhesively to the main blank by wrap-around flaps 120 that extend from each end of each of the two sidewalls 104 and a longitudinal flap 122 that extends upwardly from the bottom panel 102, being folded along the bottom edge of the end wall 106.

The container 100 described above with respect to FIG. 5 is of the general type referred to as a "bliss" box. Because it includes multiple blanks, this container 100 requires additional assembly steps. It can be fabricated using equipment available from Moen of Santa Fee Springs, Calif. Its advantage over the generally lower cost of the container 10 of FIG. 2A is that the end walls 106 and corner panels 114 as well as the extension flap 108 and attachment flap 112 can be formed of a thicker or stronger material, as compared to other panels, such as the bottom panel 102, that are formed as part of the main blank. Accordingly, added vertical or stacking strength can be obtained without using heavier and more costly material for the entire container.

Figure 6:
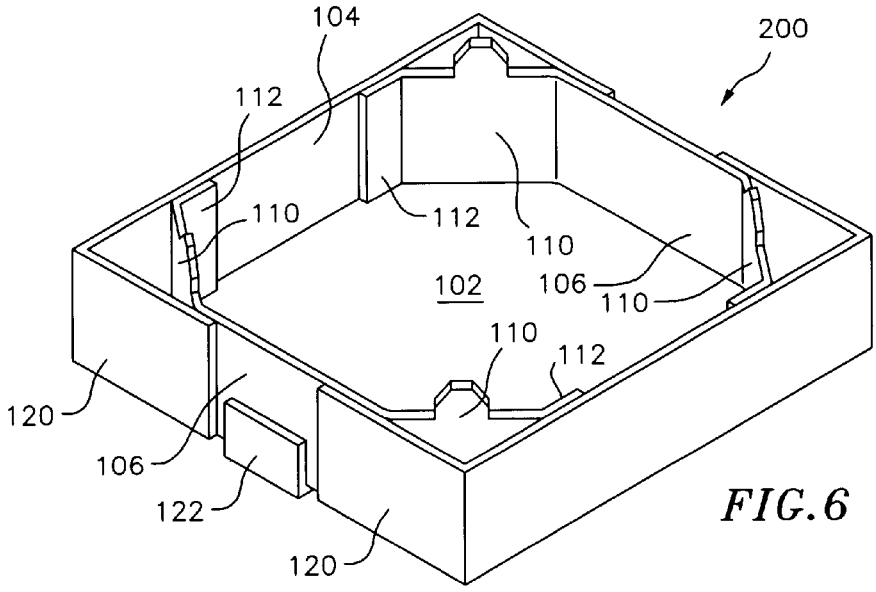

Another container 200 that embodies the present invention is shown in FIG. 6, using the same reference numbers as FIG. 5 for corresponding components. In this container 200, however, the extension flaps 108 are omitted. The end walls 106 are shorter, with the corner panels 110 being attached directly to the end walls 106 and the attachment panels 112 extending along the side walls 104.

As compared to the container 100 of FIG. 5, the container 200 of FIG. 6 does not provide as much strength, including vertical stacking strength, in the corners. This is where a container is apt to be subject to more abuse and larger forces. However, the container 200 of FIG. 6 is less costly than the container 100 of FIG. 5 because it contains less material and is simpler to assemble. It is, however, more costly than the container 10 of FIG. 2A.

Certain presently preferred embodiments of the apparatus and device for practicing the invention have been described herein in some detail and some modifications and additions have been suggested. Other modifications, improvements and additions not described in this document may also be made without departing from the principles of the invention.

What is claimed is:

1. A stackable, self-aligning, corrugated cardboard container comprising:

a rectangular bottom panel having a pair of opposite ends and a pair of opposite sides generally perpendicular to said opposite ends;

two end panels extending upwardly from said opposite ends of said bottom panel;

two side panels extending upwardly from said opposite sides of said bottom panel to a maximum height approximately the same as the height of said end panels, said end panels being adjacent to said side panels to form four corners;

four corner panels of the same height as said end panels, each corner panel extending diagonally across a corresponding one of said corners and having one end attached to a corresponding one of said end panels, and another end attached to one of said side panels adjacent to said corresponding corner panel; and at least four shaped interlocking tabs, each tab having a relatively wide base and a relatively narrow head and being integrally formed as part of a corresponding one of said four corner panels and upwardly projecting beyond said end panels, wherein said bottom panel defines a plurality of generally circular apertures arranged to receive interlocking tabs of a similar container situated below said bottom panel and having all of the features of the container, the apertures being configured such that placement of the apertures of the container over the tab heads of the similar container urges the container to shift into alignment over the similar container as the wide base of the shaped interlocking tabs engage the apertures.

2. The container of claim 1 wherein each tab is tapered from said head to said base forming two straight side edges.

3. The container of claim 1 wherein each tab is tapered from said head to said base forming two curved side edges.

4. The container of claim 1 further comprising reinforced side and end panel regions where said corner panels are attached to said side and end panels.

5. The container of claim 1 wherein each of said four corner panels defines a tab recess having a size and shape corresponding to one of said interlocking tabs formed in each corner panel above the apertures, whereby said interlocking tabs of the similar container extending through the apertures of the container can be received by the recesses.

6. The container of claim 1 further comprising:

two movable half covers, each extending from the top of a corresponding one of said side panels, the half covers having a predetermined thickness;

a base extension formed on each interlocking tab, wherein the base extension corresponds in height to the thickness of said half covers, wherein each of said half covers defines a tab channel that is arranged to receive the interlocking tabs of the container when the half covers are folded over the open container.

7. The container of claim 1 wherein said container defines a plurality of ventilation holes.

8. The container of claim 1 further comprising one or more lowered regions of side wall or end wall whereby the height of a portion of said side or end wall is lower than that portion of the side wall or end wall to which the corner panel is attached.

9. The container of claim 1 wherein the container is formed from at least three separate blanks.

10. The container of claim 1 wherein the container is formed from a main blank and two secondary blanks, the main blank comprising the bottom panel and side panels, and each of the secondary blanks comprising one of the end panels and at least two of the corner panels.

11. The container of claim 10 wherein each secondary blank further comprises an extension flap extending at a right angle from the end panel of the corresponding secondary blank and an attachment flap secured to the end panel of the corresponding secondary blank.

12. The container of claim 10 wherein each secondary blank further comprises a corner flap extending from the end panel, and an attachment flap extending from each of the corner panels, the attachment flap being secured to the side panel of the corresponding secondary blank.

13. The container of claim 10 wherein the secondary blanks are formed of a heavier material than the main blank, thereby providing the container with increased vertical stacking strength.

14. The container of claim 1 further comprising:

a corrugated cardboard top defining a plurality of similar tab channels formed therein and arranged to cover the cardboard container and receive the interlocking tabs of the stackable self-aligning corrugated cardboard container that it covers; and, a base extension, of a thickness corresponding to the thickness of said top, formed below the wide base of a corresponding one of said tabs, wherein the corresponding tab is of a sufficient height to assure that the entire corresponding tab will protrude through said top.

15. A stackable, self-aligning, box formed from a single sheet of foldable material comprising:

a rectangular bottom panel having a pair of opposite ends and a pair of opposite sides generally perpendicular to said opposite sides;

two rectangular side panels, each with two ends and two foldable end flaps, extending upwardly from the opposite sides of said bottom panel;

two rectangular end panels extending upwardly to approximately the same height as said side panels, from opposite sides of said bottom panel, said end panels meeting said ends of said side panels to form four corners;

four corner panels of the same height as said end panels, each corner panel being folded from one of the end flaps, extending diagonally across each corner, and having one end attached to the corresponding end panel and the other end attached to one of the side panels from which the flap extends; and at least four shaped interlocking tabs, each tab having a relatively wide base and a relatively narrow head, each of the interlocking tabs being integrally formed as part of a corresponding one of said corner panels, the tabs upwardly projecting beyond said end panels, wherein said bottom panel defines a plurality of generally circular apertures that are vertically aligned with the interlocking tabs to receive interlocking tabs of a similar box.

16. The box of claim 15 wherein each tab is tapered from the head to the base forming two straight side edges.

17. The box of claim 15 wherein each tab is tapered from the head to the base forming two curved side edges.

18. The box of claim 15 wherein each of the four corner panels defines a tab recess having a size and shape corresponding to one of said interlocking tabs formed in each corner panel above the apertures, whereby said interlocking tabs of the similar container extending through the apertures of the container can be received by a corresponding tab recess.

19. The box of claim 15 further comprising:

two movable half covers extending from the top of each side wall, the half covers having a predetermined thickness; and a base extension formed on each interlocking tab, wherein each base extension corresponds in height to the thickness of said half covers, wherein each of said half covers defines a tab channel arranged to receive the interlocking tabs of the box when the half covers are folded over the open box.

20. The box of claim 15 wherein said box defines a plurality of ventilation holes.

21. The box of claim 17 wherein said box defines a plurality of ventilation holes.

22. The box of claim 15 wherein the side panels or the end panels comprise one or more lowered regions, each lowered region having a height less than portions of the side panel or end panel attached to the corner panel.

23. The box of claim 17 wherein the side panels or the end panels comprise one or more lowered regions, each lowered region having a height less than portions of the side panels or end panels attached to the corner panels.

24. A stackable self-aligning box formed from a single sheet of foldable corrugated cardboard comprising:

a rectangular bottom panel having a pair of opposite ends and a pair of opposite sides generally perpendicular to said opposite ends;

two rectangular side panels extending upwardly from the opposite sides of said bottom panel, each side panel having two ends;

two rectangular end panels extending upwardly to the same height as said side panels from the opposite sides of said bottom panel, the end panels meeting said side panels to form four corners;

a foldable corner support at each end of each side panel with first, second and third vertical score lines;

four corner panels having the same height as said end panels, the corner panels being folded from each corner support along said score lines, each corner panel comprising:

a first corner wall between the first and second score lines at 90 degrees from one of the side panels from which the first corner wall extends, the first corner wall being permanently affixed to a corresponding one of the end panels adjacent to the first corner;

a second corner wall adjacent to the first corner wall, between the second and third score lines, the second corner wall extending diagonally across each corner with an integrally formed tapered interlocking tab extending upwardly above said end panels, each tab having a maximum width;

a third corner wall adjacent to the second corner wall, between the third score line and the end of the corner support, the third corner wall being permanently affixed against one of the side panels from which the corner support extends; and double thick regions of attachment formed where each of said first corner walls and said third corner walls are affixed to the side or end panels, wherein said bottom panel defines a plurality of circular apertures, the diameter of each aperture being approximately equal to the maximum width of said tab, and each corner panel defines a tab recess corresponding to said tab, each tab recess being formed in each corner panel above a corresponding one of said apertures.

25. A stackable, self-aligning, corrugated cardboard container comprising:

a bottom panel;

at least one side panel extending upwardly from the bottom panel to a predetermined height;

at least one end panel extending upwardly from the bottom panel to a maximum height approximately the same as the height of the at least one side panel, the at least one end panel meeting the at least one side panel to form a corner;

at least one corner panel having a first end and an opposite end, the corner panel being the same height as the at least one end panel, the at least one corner panel extending diagonally across the corner, wherein the at least one corner panel is arranged with the first end attached to the at least one end panel and the opposite end attached to the at least one side panel adjacent to the at least one corner panel; and at least one shaped interlocking tab having a relatively wide base and a relatively narrow head integrally formed as part of the corner panel, the at least one shaped interlocking tab upwardly projecting beyond the at least one end panel, wherein said bottom panel defines at least one generally circular aperture that is vertically aligned with the at least one shaped interlocking tab.

26. The container of claim 25 wherein the tab is tapered from the head to the base forming two straight side edges.

27. The container of claim 25 wherein the tab is tapered from the head to the base forming two curved side edges.

28. The container of claim 25 further comprising reinforced side and end panel regions where at least one corner panel is attached to the side and end panels.

29. The container of claim 25 wherein the corner panel above the aperture defined by the bottom panel defines a tab recess of a size and shape corresponding to the interlocking tab.

30. The container of claim 25, wherein the corrugated cardboard container includes at least two side panels and at least two shaped interlocking tabs, the corrugated cardboard container further comprising:

two movable half covers extending from the top of the at least two side panels, the half covers having a predetermined thickness; and a base extension formed on at least one of the interlocking tabs, wherein the base extension corresponds in height to the thickness of the half covers, wherein each of said half covers defines at least one tab channel arranged to receive at least one the interlocking tabs of the container when the half covers are folded over the open container.

31. The container of claim 25 further comprising one or more lowered regions of the at least one side panel or the end panel whereby the height of a portion of the at least one side panel or the end panel is lower than portions of the at least one side panel or the end panel attached to the corner panel.

32. The container of claim 25 wherein the container is formed from at least three separate blanks.

33. The container of claim 25 wherein the container is formed from a main blank and two secondary blanks, the main blank comprising the bottom panel and the at least one side panel, and each of the secondary blanks comprising at least one end panel and at least one corner panel.

34. The container of claim 33 further comprising, as part of each secondary blank, an extension flap extending at a right angle from at least one end panel and an attachment flap secured to at least one end panel.

35. The container of claim 33 wherein each secondary blank further comprises a corner flap extending from the end panel, and an attachment flap extending from the at least one corner panel, the attachment flap being secured to the at least one side panel of the corresponding secondary blank.

36. The container of claim 33 wherein the secondary blanks are formed of a heavier material than the main blank, thereby providing the container with increased vertical stacking strength.

* * * * *